US010559924B2

(12) United States Patent
Ochiai et al.

(10) Patent No.: US 10,559,924 B2
(45) Date of Patent: Feb. 11, 2020

(54) CONNECTOR

(71) Applicants: YAZAKI CORPORATION, Tokyo (JP); HONDA MOTOR CO., LTD., Tokyo (JP)

(72) Inventors: Kazuyuki Ochiai, Saitama (JP); Daisuke Fujihira, Saitama (JP); Shintaro Matsuda, Saitama (JP); Kozo Oishi, Tochigi (JP); Tomoyuki Miyakawa, Tochigi (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/402,189

(22) Filed: May 2, 2019

(65) Prior Publication Data

US 2019/0260163 A1 Aug. 22, 2019

Related U.S. Application Data

(63) Continuation of application No. PCT/JP2017/038050, filed on Oct. 20, 2017.

(30) Foreign Application Priority Data

Dec. 6, 2016 (JP) ..... 2016-236633

(51) Int. Cl.
*H01R 13/62* (2006.01)
*H01R 13/641* (2006.01)
(Continued)

(52) U.S. Cl.
CPC ..... *H01R 13/641* (2013.01); *H01R 13/627* (2013.01); *H01R 13/635* (2013.01); *H01R 13/639* (2013.01); *H01R 13/64* (2013.01)

(58) Field of Classification Search
CPC .. H01R 13/641; H01R 13/627; H01R 13/635; H01R 13/639
(Continued)

(56) References Cited

U.S. PATENT DOCUMENTS 5,718,596 A 2/1998 Inaba et al.
6,171,130 B1 1/2001 Yoshida et al.
(Continued)

FOREIGN PATENT DOCUMENTS

EP 1 059 699 A2 12/2000
JP 8-242087 A 9/1996
(Continued)

OTHER PUBLICATIONS

International Search Report and Written Opinion of the International Search Report for PCT/JP2017/038050 dated Nov. 28, 2017.
(Continued)

*Primary Examiner* — Khiem M Nguyen
(74) *Attorney, Agent, or Firm* — Kenealy Vaidya LLP

(57) ABSTRACT

The connector includes an inner housing, an outer housing, a locking mechanism for locking, a spring member that pushes back the inner housing during half fitting, and a pushback regulating position that regulates a pushback position. The pushback regulating portion includes a claw portion, a stepped portion against which the claw portion abuts, and a sliding load portion that makes a sliding friction force between the inner housing and the outer housing at a predetermined timing before abutting to be larger than the sliding friction force before the predetermined timing.

2 Claims, 16 Drawing Sheets

(51) Int. Cl.

| | |
|---|---|
| ***H01R 13/627*** | (2006.01) |
| ***H01R 13/635*** | (2006.01) |
| ***H01R 13/639*** | (2006.01) |
| ***H01R 13/64*** | (2006.01) |

(58) Field of Classification Search
USPC ..... 439/152, 489, 923
See application file for complete search history.

(56) References Cited

U.S. PATENT DOCUMENTS

| | | | |
|---|---|---|---|
| 6,475,015 | B1 | 11/2002 | Murakami et al. |
| 2003/0022548 | A1 | 1/2003 | Lutsch et al. |

FOREIGN PATENT DOCUMENTS

| | | | |
|---|---|---|---|
| JP | 9-134757 | A | 5/1997 |
| JP | 10-223311 | A | 8/1998 |
| JP | 11-224728 | A | 8/1999 |
| JP | 2000-357562 | A | 12/2000 |
| JP | 2003-59586 | A | 2/2003 |

OTHER PUBLICATIONS

Japanese Office Action for the related Japanese Patent Application No. 2016-236633 dated Jan. 8, 2019.

CONNECTOR

CROSS REFERENCE TO RELATED APPLICATIONS

This application is a continuation of PCT application No. PCT/JP17/038050, which was filed on Oct. 20, 2017 based on Japanese Patent Application (No. 2016-236633) filed on Dec. 6, 2016, the contents of which are incorporated herein by reference.

BACKGROUND OF THE INVENTION

1. Field of the Invention

The present invention relates to a connector that is configured to forcibly release a fitting operation by a biasing force of spring members when the connector is half-fitted with a mating connector (a state before complete fitting).

2. Description of the Related Art

As this kind of connector, a connector according to JP-A-11-224728 includes a tubular inner housing that holds a plurality of connecting terminals therein, a tubular outer housing that surrounds an outer periphery of the inner housing and is slidable in a fitting direction, a locking mechanism that locks the inner housing with a mating connector at a fitting position, a spring member that biases the inner housing to the rear in the fitting direction to push back the inner housing with respect to the outer housing if a fitting operation is released when the inner housing is in a half fitting position, and a pushback regulating portion that regulates a position where the inner housing is pushed back to the rear in the fitting direction. The pushback regulating portion includes a claw portion that protrudes from the outer periphery of the inner housing and a stepped portion that is provided in the outer housing and against which the claw portion can abut when the inner housing is pushed back. The stepped portion is configured by a rear end surface of a long hole provided to notch a part of the outer housing in the fitting direction.

In JP-A-11-224728, when the inner housing is pushed into the mating connector so that the mating connector is covered by the outer housing, the outer housing pushed against the mating connector moves to the rear in the fitting direction while compressing the spring member. When the inner housing is locked to the inner housing by the locking mechanism, the outer housing biased by the spring member is pushed out to the fitting direction and fitting of both connectors is completed.

When a hand moves away from the inner housing in a half fitting state before complete fitting, the compressed spring member biases the inner housing in a direction away from the outer housing. As a result, while the mating connector is pushed back by the outer housing, the inner housing is pushed back to the rear in the fitting direction, so that the fitting operation is forcibly released and half fitting of the connectors can be detected. In this case, the inner housing pushed back to the rear in the fitting direction by the spring member prevents backward detachment in the fitting direction by making the claw portion of the pushback regulating portion to abut against the stepped portion of the outer housing.

Since the connector of JP-A-11-224728 is a multipolar connector having multiple terminals and sliding friction between the terminals during connection (fitting) with the mating connector is large, the biasing force of the spring member (spring constant) may be set large in order to detect half fitting. However, if the biasing force of the spring member is too large, troubles may occur in the pushback regulating portion due to an impact that acts on the pushback regulating portion when the claw portion of the pushback regulating portion abuts against the stepped portion during half fitting.

SUMMARY OF THE INVENTION

For the connector including a mechanism that pushes back a housing by utilizing the biasing force of the spring member during half fitting, an object of the present invention is to provide a connector capable of reducing the impact that acts on the mechanism.

A "connector" according to the present invention has the following feature (1) and further preferably has the following features (2) to (4).

(1) The connector includes a tubular inner housing that holds connecting terminals therein; a tubular outer housing that surrounds an outer periphery of the inner housing and is slidable in a fitting direction; a locking mechanism that locks the inner housing with a mating connector at a fitting position; a spring member that biases the inner housing to the rear in the fitting direction to push back the inner housing with respect to the outer housing if a fitting operation is released when the inner housing is in a half fitting position; and a pushback regulating portion that regulates a position where the inner housing is pushed back to the rear in the fitting direction, wherein the pushback regulating portion includes a claw portion that protrudes from a first sliding surface of one of the inner housing and the outer housing; a stepped portion that is provided on a second sliding surface of the other of the inner housing and the outer housing and against which the claw portion can abut when the inner housing is pushed back; and a sliding load portion that makes a sliding frictional force between the first sliding surface and the second sliding surface at a predetermined timing before the claw portion and the stepped portion abut against each other to be larger than the sliding frictional force before the predetermined timing.

According to the connector having the above feature (1), when the fitting operation is released during half fitting, a speed at which the inner housing is pushed back to the rear in the fitting direction by the biasing force of the spring member is reduced by the sliding frictional force of the sliding load portion. Accordingly, since an impact that acts on the pushback regulating portion when the claw portion of the pushback regulating portion abuts against the stepped portion can be reduced, even though the biasing force of the spring member is increased, the occurrence of troubles can be suppressed in the pushback regulating portion.

(2) The connector according to (1), wherein the sliding load portion is an inclined surface provided at a position, closer to the stepped portion than the claw portion, of the first sliding surface and includes the inclined surface inclined to be away from the first sliding surface as approaching the claw portion.

According to the connector having the above feature (2), before the claw portion of the pushback regulating portion abuts against the stepped portion, the sliding frictional force between the sliding surfaces can be increased by a mating sliding surface (second sliding surface) getting on the inclined surface of one sliding surface (first sliding surface). Therefore, a moving speed of the claw portion during pushing back the housing can be reduced. Accordingly, the impact that acts on the pushback regulating portion when the claw portion of the pushback regulating portion abuts against the stepped portion can be reduced.

(3) The connector according to (1), wherein the sliding load portion includes a first protruding portion provided at a position, closer to the stepped portion than the claw portion, of the first sliding surface; and a second protruding portion provided on the second sliding surface to be capable of getting over the first protruding portion.

According to the connector having the above feature (3), before the claw portion of the pushback regulating portion abuts against the stepped portion, the sliding frictional force between the sliding surfaces can be increased by the second protruding portion of the mating sliding surface (second sliding surface) getting over the first protruding portion of one sliding surface (first sliding surface). Therefore, the moving speed of the claw portion during pushing back the housing can be reduced. Accordingly, the impact that acts on the pushback regulating portion when the claw portion of the pushback regulating portion abuts against the stepped portion can be reduced.

(4) The connector according to (1), wherein the sliding load portion includes an arm portion configured to elastically press one of the first sliding surface and the second sliding surface toward the other; and a third protruding portion provided on the other of the first sliding surface and the second sliding surface in sliding contact with the arm portion.

According to the connector having the above feature (3), before the claw portion of the pushback regulating portion abuts against the stepped portion, the sliding frictional force between the sliding surfaces can be increased by the arm portion (for example, an arm portion provided on one of the inner housing and the outer housing), which is configured to elastically press one of the first sliding surface and the second sliding surface toward the other, slidably contacting the third protruding portion of the mating sliding surface. Therefore, the moving speed of the claw portion during pushing back the housing can be reduced. Accordingly, the impact that acts on the pushback regulating portion when the claw portion of the pushback regulating portion abuts against the stepped portion can be reduced. In this case, since the arm portion and the third protruding portion may be provided at positions where the arm portion can be in sliding contact with the third protruding portion before the claw portion abuts against the stepped portion, the sliding load portion can be designed more freely.

According to the present invention, in a connector including a mechanism that pushes back a housing by utilizing a biasing force of a spring member during half fitting, a connector capable of reducing an impact that acts on the mechanism can be provided.

The present invention has been briefly described above. Further, details of the invention will be clarified by reading a mode (hereinafter, referred to as "embodiment") for carrying out the invention to be described below with reference to attached drawings.

DETAILED DESCRIPTION OF THE EXEMPLARY EMBODIMENTS

First Embodiment

Figure 1:
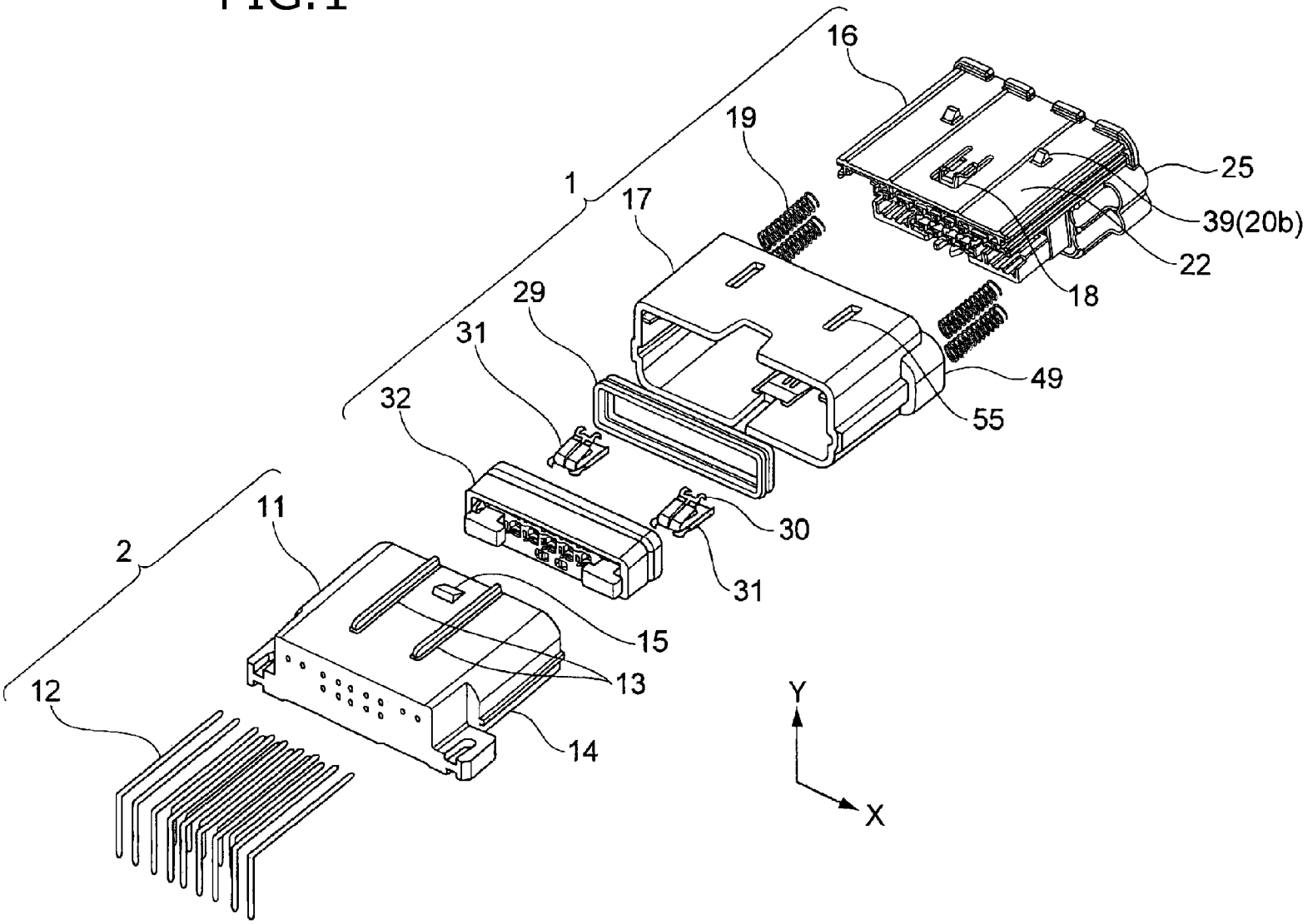
FIG. 1 is an exploded perspective view of a connector and a mating connector according to a first embodiment of the present invention.

Hereinafter, a first embodiment of the present invention will be described with reference to FIGS. 1 to 10. As shown in FIG. 1, a connector 1 of the present embodiment is a female connector that can be fitted with a male mating connector 2, and includes a mechanism that forcibly releases a fitting operation when the fitting operation is released in a half fitting state where the connector 1 is not completely fitted with the mating connector 2. Hereinafter, it is described that directions in which the connectors 1 and 2 approach each other are defined as the front in the fitting directions, an X direction in FIG. 1 is defined as a width direction, and a Y direction is defined as a height direction.

As shown in FIG. 1, the mating connector 2 includes a resin mating housing 11 that is formed in a rectangular tubular shape and open in the front, and a plurality of male mating terminals 12 whose tip end portions are accommodated and held in the mating housing 11. An outer peripheral surface of the mating housing 11 are provided with two first protruding strip portions 13 that extend longitudinally on an upper surface, second protruding strip portions 14 that extend longitudinally respectively on both sides in the width direction, and a locking protrusion 15 that protrudes from the center portion of the upper surface in the width direction. The locking protrusion 15 has a function of locking the two connectors 1 and 2 at the fitting position thereof.

As shown in FIGS. 1 to 6, the connector 1 includes a resin inner housing 16 that is form in a rectangular tubular shape and open in the front, a plurality of female connecting terminals (not shown) that is accommodated and held inside the inner housing 16 and connected to the mating terminals 12 during fitting of the two connectors 1 and 2, a resin outer housing 17 that surrounds an outer periphery of the inner housing 16 and slides in the fitting direction, a locking mechanism 18 that locks the inner housing 16 with the mating connector 2 at the fitting position, coil shape spring members 19 that bias the inner housing 16 to the rear in the fitting direction to push back the inner housing 16 with respect to the outer housing 17 when the fitting operation of the two connectors 1 and 2 is released in the half fitting position of the two connectors 1 and 2 thereby unlocking the locking mechanism 18, and a pushback regulating portion 20 that regulates a position where the inner housing 16 is push back to the rear in the fitting direction.

Figure 7:
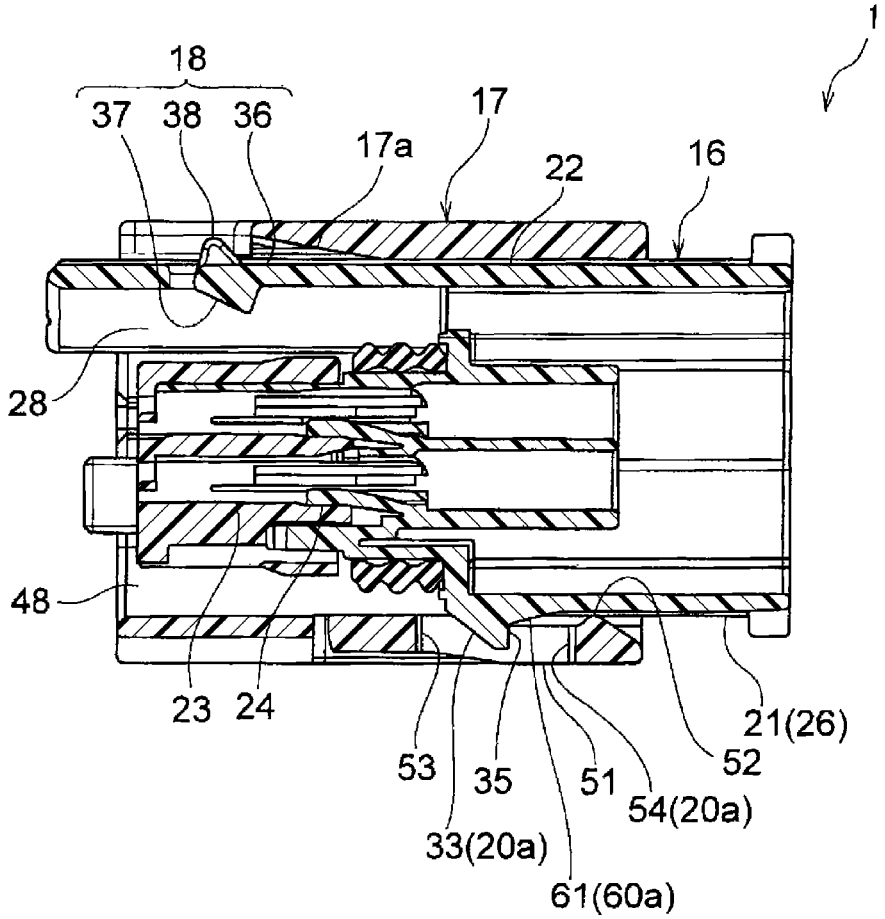
FIG. 7 is a cross-sectional view showing one form in a direction indicated by arrows A to A in FIG. 6.

The inner housing 16 includes a rectangular tubular housing body 21 and a flat plate-like hood portion 22 that is connected to an upper portion of the housing body 21 and protrudes forward than a front end of the housing body 21. A plurality of terminal accommodating chambers 23 are formed in the housing body 21. The mating terminals 12 are inserted into the terminal accommodating chambers 23 respectively from front openings of the chambers while the connecting terminals are inserted into the terminal accommodating chambers 23 respectively from the rear. Each of the terminal accommodating chambers 23 is provided with a flexible lance 24 that locks the connecting terminal to prevent from coming off (FIG. 7). Both sides in the width direction of the rear of the housing body 21 are provided with a total of four first spring accommodating portions 25 that support rear portions of the spring members 19.

Figure 5:
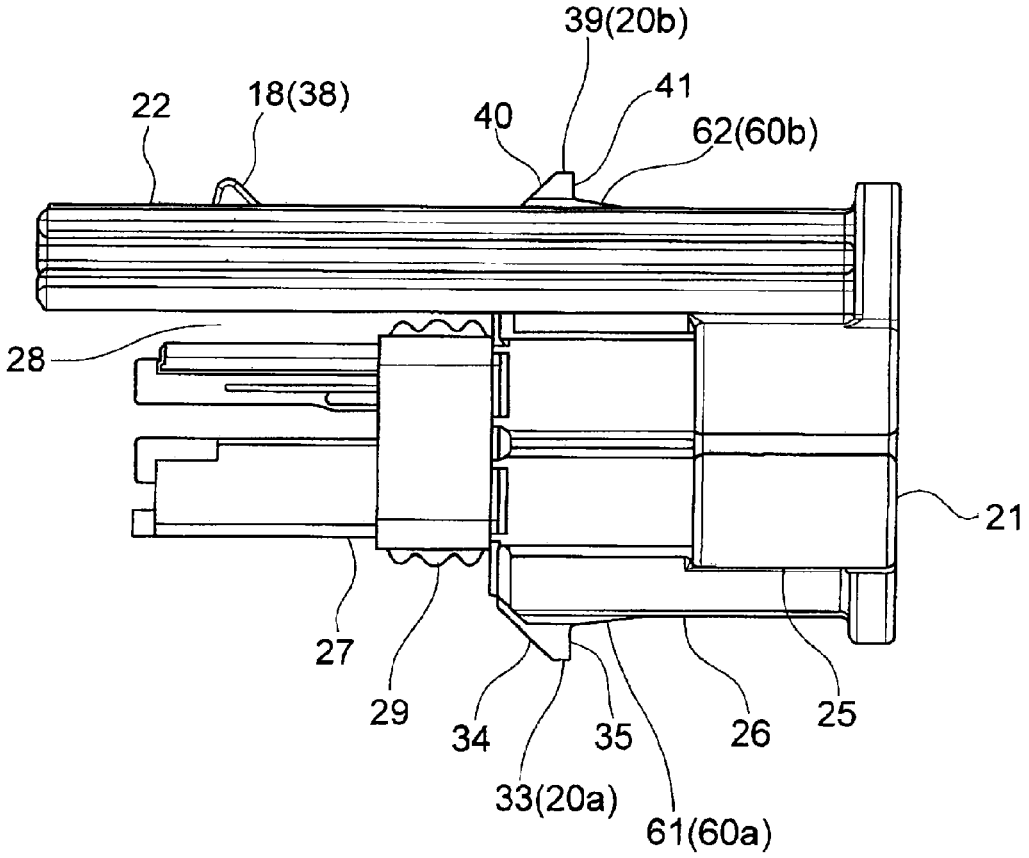
FIG. 5 is a side view of the inner housing of FIG. 4.

As shown in FIG. 5, the housing body 21 includes a rectangular tubular base portion 26 having a hood portion 22 connected to the upper portion thereof, and a rectangular tubular front portion 27 formed corresponding to an inner peripheral surface of the mating housing 11 frontward than the base portion 26. The front portion 27 is set to be smaller in height dimension and width dimension than the base portion 26. Between the front portion 27 of the housing body 21 and the hood portion 22, a fitting space 28 into which the mating housing 11 enters is secured. On the outer peripheral surface rearward than the front portion 27 of the housing body 21, an annular packing 29 is mounted to seal a gap between the outer peripheral surface of the housing body 21 and the inner peripheral surface of the mating housing 11 when the two connectors are fitted with each other. At an opening of the front portion 27 of the housing body 21, a short terminal 31 including an elastic contacting piece 30 at a position corresponding to the connecting terminal is assembled from the front, and a front holder 32 for locking the lance 24 of each terminal accommodating chamber 23 is fitted. On a lower surface of the base portion 26 of the housing body 21, a first claw portion 33 that configures the pushback regulating portion 20 protrudes at the center portion in the width direction. The first claw portion 33 has a front inclined surface 34 inclined frontward toward the lower surface of the base portion 26, and a rear end surface 35 that is substantially orthogonal to the lower surface of the base portion 26.

Figure 2:
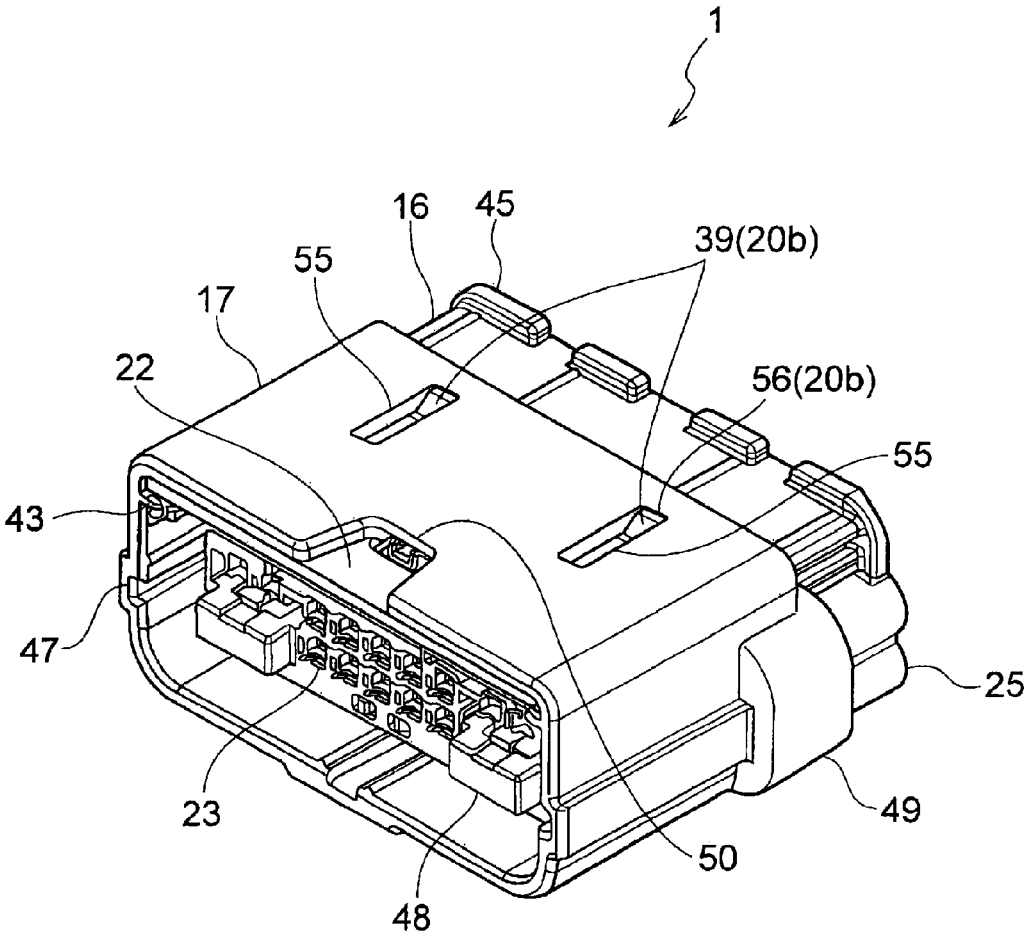
FIG. 2 is an upper perspective view of the connector according to the first embodiment of the present invention.
Figure 3:
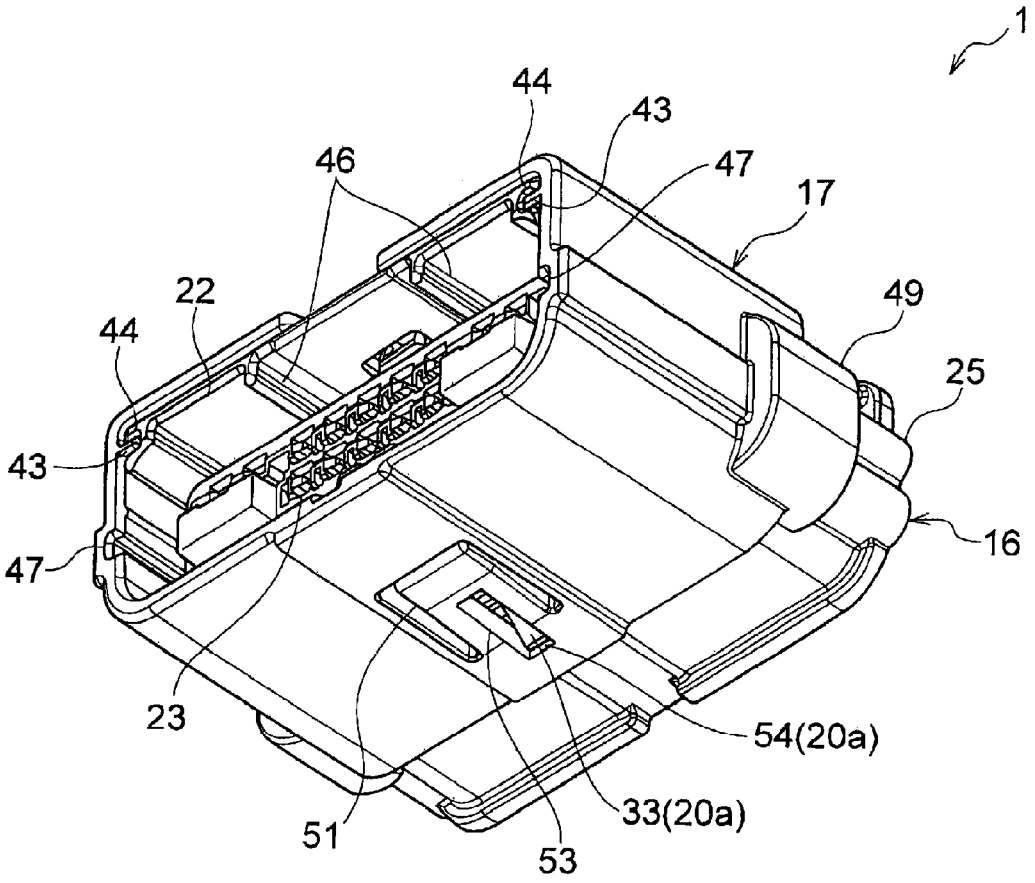
FIG. 3 is a lower perspective view of the connector according to the first embodiment of the present invention.
Figure 4:
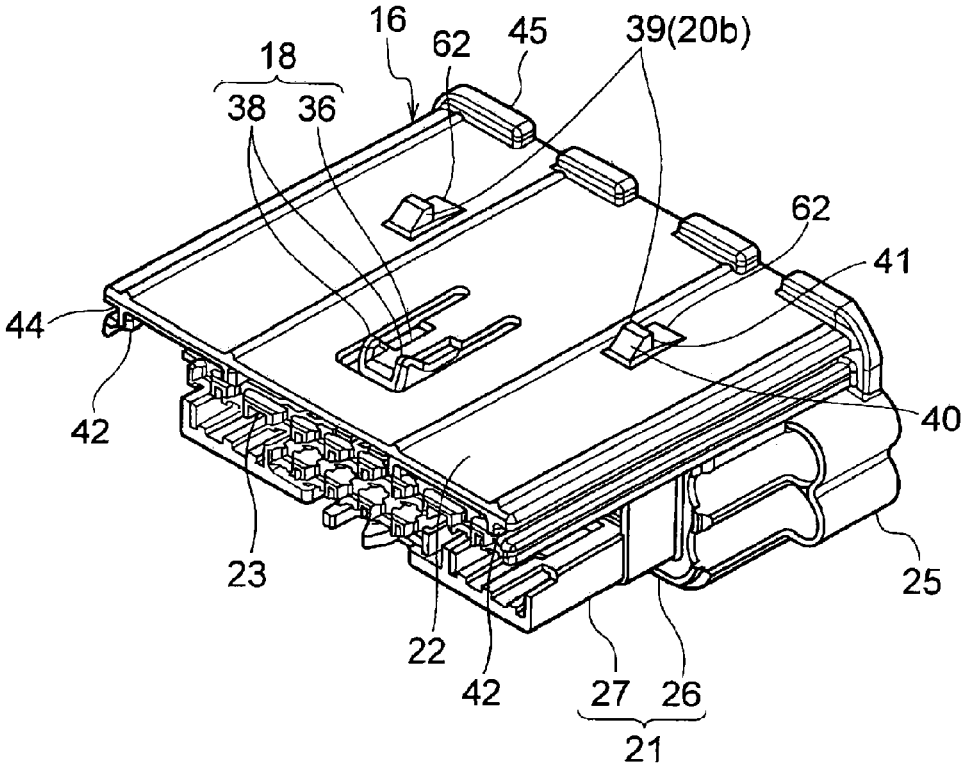
FIG. 4 is an external perspective view of an inner housing.

As shown in FIGS. 4 and 7, the hood portion 22 is provided with the locking mechanism 18 at the center portion in the width direction. The locking mechanism 18 is configured to include a lock arm 36 that is formed to be elastically deformable up and down and extends in the fitting direction by notching the hood portion 22, a first protrusion 37 having a triangular cross section that protrudes downward from the hood portion from a tip end portion of the lock arm 36, and second protrusions 38 having a triangular cross section that protrude upward from the hood portion respectively from both side edges in the width direction of the tip end portion of the lock arm 36. The first protrusion 37 locks the inner housing 16 and the mating housing 11 by locking the locking protrusion 15 of the mating housing 11 that enters the fitting space 28 of the gap between the front portion 27 of the housing body 21 and the hood portion 22. When the outer housing 17 is pushed out in the fitting direction, the second protrusion 38 is formed to be capable of contacting the inner peripheral surface (an inclined surface 17*a* in FIG. 7) of a front end portion of the outer housing 17. On an upper surface of the hood portion 22, second claw portions 39 that configure the pushback regulating portion 20 protrude at two positions on both sides in the width direction. The second claw portion 39 has a front inclined surface 40 inclined frontward toward the upper surface of hood portion 22, and a rear end surface 41 that is substantially orthogonal to the upper surface of the hood portion 22. Both side edges in the width direction of the hood portion 22 are provided with edge portions 42 that hang downward longitudinally. An outer side surface of each edge portion 42 is provided with a groove 44 locked with a rib 43 (FIG. 2) that protrudes from an inner periphery of the outer housing 17. A rear end portion of the hood portion 22 is provided with a regulating rib 45 for abutting against a rear end surface of the outer housing 17 to prevent detachment of the inner housing 16 in the fitting direction. As shown in FIG. 3, a pair of guide ribs 46 that guide the two first protruding strip portions 13 of the mating housing 11 protrude from a lower surface of the hood portion 22.

As shown in FIG. 3, the outer housing 17 is a frame body formed in a rectangular tubular shape, and the inner housing 16 is assembled from the rear thereof. The outer housing 1 slidably holds the inner housing 16 in the fitting direction by locking the ribs 43 that protrude from inner peripheral surfaces of the outer housing 17 in the grooves 44 of the edge portions 42 on both sides in the width direction of the inner housing. The inner peripheral surface of the outer housing 17 is formed to be in sliding contact with both side surfaces in the width direction and the lower surface of the base portion 26 of the housing body 21 of the inner housing 16, and has guide grooves 47 that guide the two second protruding strip portions 14 of the mating housing 11.

Figure 6:
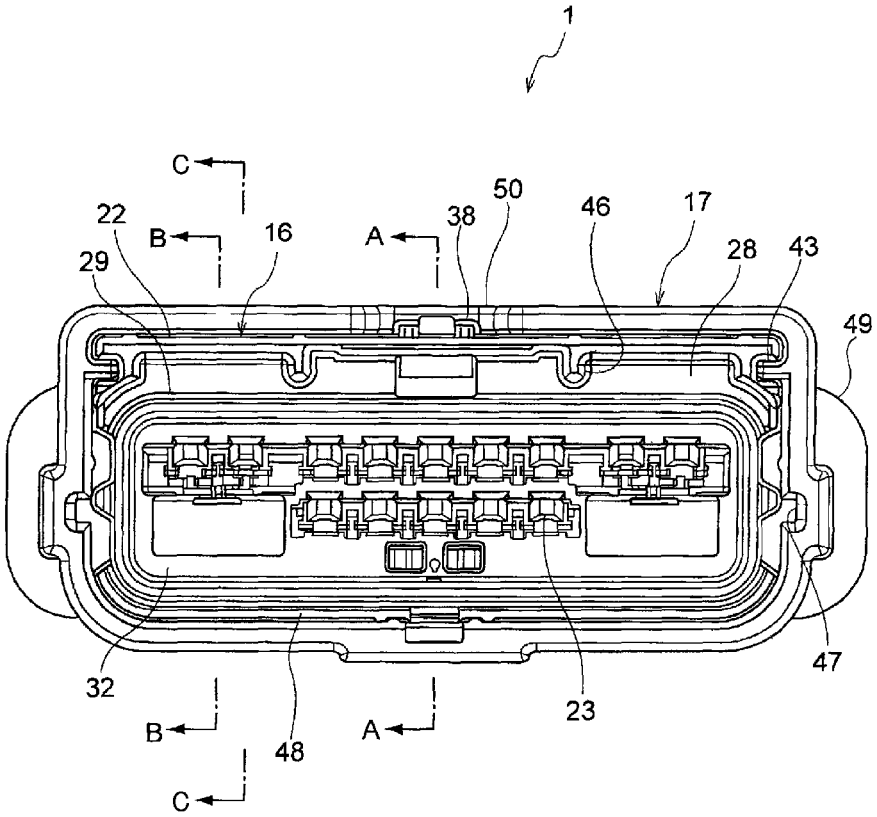
FIG. 6 is a front view of the connector.

As shown in FIG. 6, the outer housing 17 ensures an annular fitting space 48 for a mating housing to enter, between the inner peripheral surface of the outer housing 17 and an outer peripheral surface of the front portion 27 of the housing body 21 of the inner housing 16, when the inner housing 16 is fitted to the outer housing 17. Both sides in the width direction of the outer housing 17 are provided with a total of four second spring accommodating portions 49 that support front portions of the spring member 19. As shown in FIG. 2, a front end central portion of an upper portion of the outer housing 17 is provided with a notch portion 50 to allow upward elastic deformation of the lock arm 36 of the inner housing 16. The inner peripheral surface of the outer housing 17 on an innermost side of the notch portion 50 is provided with the inclined surface 17*a* against which the second protrusion 38 of the lock arm 36 abuts when the two connectors 1 and 2 are fitted with each other.

As shown in FIGS. 3 and 7, a lower portion of the outer housing 17 is provided with an arm piece 51 that is formed to be elastically deformable up and down and extends inward to the front (fitting direction) by longitudinally notching the center portion in the width direction, and a protruding portion 52 that protrudes from the inner surface rearward than the arm piece 51. A front end surface of the arm piece 51 that abuts against the mating housing 11 is disposed in the fitting space 48 and the arm piece 51 is provided with a rectangular first hole portion 53 whose longitudinal direction is a front-rear direction. The protruding portion 52 is formed to slidably contact the lower surface of the base portion 26 of the housing body 21 of the inner housing 16 that is assembled to the outer housing 17, and is a part of a sliding surface of the outer housing 17 in sliding contact with the inner housing 16. When the inner housing 16 assembled to the outer housing 17 slides in the fitting direction, the first hole portion 53 is formed such that the first claw portion 33 that protrudes from a lower surface of the housing body 21 of the inner housing 16 can move through the hole, and has a first stepped portion 54 against which the rear end surface 35 of the first claw portion 33 abuts when the inner housing 16 moves to the rear in the fitting direction. The first stepped portion 54 is provided at a position where the rear end surface 35 of the first claw portion 33 can abut when the inner housing 16 is retracted to a set position in the rear in the fitting direction. As described above, a pushback regulating portion 20*a* includes the first claw portion 33 and the first stepped portion 54.

Figure 8:
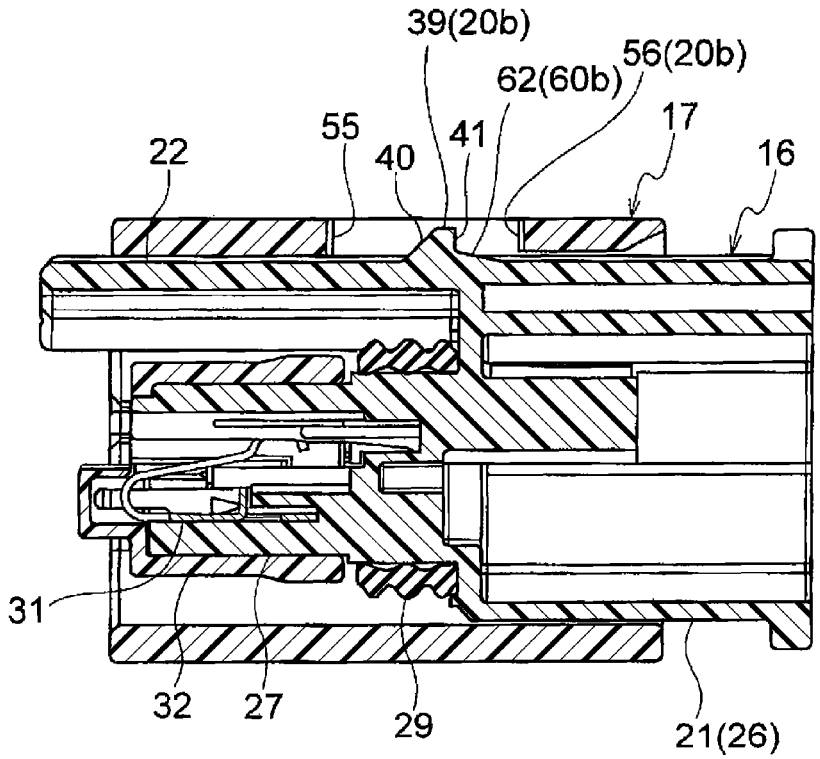
FIG. 8 is a cross-sectional view showing one form in a direction indicated by arrows B to B in FIG. 6.

As shown in FIGS. 2 and 8, the upper portion of the outer housing 17 is provided with a pair of rectangular second hole portions 55, respectively on both sides in the width direction, whose longitudinal direction is the front-rear direction. When the inner housing 16 assembled to the outer housing 17 slides in the fitting direction, the pair of second hole portions 55 are formed so that the second claw portion 39 corresponding to the inner housing 16 can move through each of the holes, and has second stepped portions 56 against each of which the rear end surface 41 of the second claw portion 39 abuts when the inner housing 16 moves to the rear in the fitting direction. The second stepped portions 56 are provided at positions where the rear end surfaces 41 of the second claw portions 39 can respectively abut when the inner housing 16 is retracted to the set position in the rear in the fitting direction. As described above, a pushback regulating portion 20*b* includes the second claw portions 39 and the second stepped portions 56.

Accordingly, as shown in FIGS. 2 and 3, the connector 1 of the present embodiment include the pushback regulating portion 20*a* including the first claw portion 33 and the first stepped portion 54, and a pushback regulating portion 20*b* including the second claw portions 39 and the second stepped portions 56. Therefore, when the fitting operation of the two connectors is released in the half fitting state and the inner housing 16 is pushed back to the rear in the fitting direction by the biasing force of the spring member 19 as will be described later, the first claw portion 33 abuts against the first stepped portion 54 and the second claw portion 39 abuts against the second stepped portion 56, so that the movement of the inner housing 16 in the half fitting direction is regulated and the detachment of the inner housing 16 with respect to the outer housing 17 is prevented. Although the first stepped portion 54 and the second stepped portion 56 form side walls of the rectangular hole portions, the shape of the hole forming each stepped portion is not particularly limited.

As a procedure for assembling the connector 1 described above, the connecting terminals to which electric wires are respectively connected are inserted into the terminal accommodating chambers 23 of the inner housing 16 respectively from the rear and locked to the lances 24, and the packing 29 and the front holder 32 are fitted into the inner housing 16 from the front. Subsequently, in a state where rear end portions of the spring members 19 are mounted to the first spring accommodating portions 25 of the inner housing 16 and front end portions of the spring members 19 are mounted to the second spring accommodating portions 49 of the outer housing 17, the inner housing 16 is assembled to the outer housing 17 while compressing the spring members 19 from the rear of the outer housing 17. When the first claw portion 33 and the second claw portions 39 of the inner housing 16 are respectively locked with the first stepped portion 54 and the second stepped portions 56 of the outer housing 17, the assembly of the connector 1 is completed.

Next, in order to fit and connect the connector 1 assembled in this way to the mating connector 2, first, the outer housing 17 of the connector 1 is placed over the mating housing 11, and the inner housing 16 is pushed against the mating connector 2. Next, a front portion of the mating housing 11 is fitted into the fitting space 48 between the inner housing 16 and the outer housing 17, and the outer housing 17 in which a front end portion of the arm piece 51 is pushed against the front portion of the mating housing 11 is retracted while compressing the spring members 19. At this time, the locking protrusion 15 of the mating housing 11, which enters the fitting space 28 between the front portion 27 of the inner housing 16 and the hood portion 22, is locked to the first protrusion 37 downwardly provided on the lock arm 36 which serves as the locking mechanism 18 of the inner housing 16 by pushing the first protrusion 37 of the lock arm 36 and deflecting the lock arm 36 upward. Accordingly, an upward deflection of the lock arm 36 is eliminated, the outer housing 17 biased by the spring members 19 is pushed out in the fitting direction, and the biasing force of the spring members 19 is released, thereby reaching a complete fitting of the two connectors 1 and 2 and completing the fitting connection. When the outer housing 17 is pushed out in the fitting direction, the inclined surface 17*a* of the notch portion 50 of the outer housing 17 is brought into contact with the upward second protrusion 38 of the lock arm 36 and the upward deflection of the lock arm 36 is regulated, so that a fitting state of the two connectors 1 and 2 is maintained.

When a hand moves away from the inner housing 16 in the half fitting state before the two connectors 1 and 2 are completely fitted, that is, in a state where the locking mechanism 18 is in the half fitting position, the outer housing 17 biased by the spring members 19 pushes back the mating connector 2, while the inner housing 16 is pushed back to the rear in the fitting direction. Accordingly, since the two connectors 1 and 2 are separated from each other and the fitting operation is forcibly released, half fitting of the connector 1 can be detected.

In a multipolar connector that accommodates a plurality of connecting terminals as the connector 1 of the present embodiment, since sliding friction between the terminals at the time of connection (fitting) with the mating connector 2 is increased, the biasing force (spring constant) of the spring members 19 may be set large in order to detect half fitting. However, if the biasing force of the spring member 19 is too large, the impact that acts on the pushback regulating portion 20 when the claw portions 33, 39 of the pushback regulating portion 20 abut against the corresponding stepped portions 54, 56 during half fitting is also large, troubles may occur in the pushback regulation portion 20.

In this respect, the connector 1 of the present embodiment is provided with sliding load portions 60 that increase the sliding friction by cooperation of both sliding surfaces, before the claw portions 33, 39 abut against corresponding stepped portions 54, 56 respectively with respect to the sliding surfaces of the inner housing 16 and the outer housing 17, which are in sliding contact with each other. Specifically, the sliding load portions 60 of the present embodiment have sliding load portions 60*a* and 60*b* at positions corresponding to the first claw portion 33 and the second claw portions 39 of the inner housing 16 respectively.

As shown in FIG. 7, the sliding load portion 60*a* is a first inclined surface 61 provided closer to a first stepped portion 54 side (rearward in the fitting direction) than a position where the first claw portion 33 of the lower surface (one sliding surface) of the base portion 26 of the housing body 21 of the inner housing 16 is formed, and has the first inclined surface 61 inclined away from the lower surface (one sliding surface) of the base portion 26 (the height from the lower surface of the base portion 26 becomes larger) as approaching the first claw portion 33. The protruding portion 52 that is a sliding surface of a corresponding inner periphery of the outer housing 17 can be in sliding contact with the first inclined surface 61.

As shown in FIG. 8, the sliding load portion 60*b* is a second inclined surface 62 provided closer to a second stepped portion 56 side (rearward in the fitting direction) than a position where each second claw portion 39 of the upper surface (one sliding surface) of the hood portion 22 of the inner housing 16 is formed, and has the second inclined surface 62 inclined away from the upper surface (one sliding surface) of the hood portion 22 (the height from the upper surface of the hood portion becomes larger) as approaching the second claw portion 39. A sliding surface of a corresponding inner periphery of the outer housing 17 can be in sliding contact with the second inclined surface 62.

The first inclined surface 61 has a width dimension (for example, the same width dimension as that of the first claw portion 33) accommodated in the first hole portion 53, and an upper end of the inclined surface is formed to extend from the rear end surface 35 of the first claw portion 33. The second inclined surface 62 has a width dimension (for example, the same width dimension as that of the second claw portion 39) accommodated in the second hole portion 55, and an upper end of the inclined surface is form to extend from the rear end surface 41 of the second claw portion 39. Each of the inclined surfaces 61 and 62 can also be provided separately from the claw portions 33 and 39.

Figure 9:
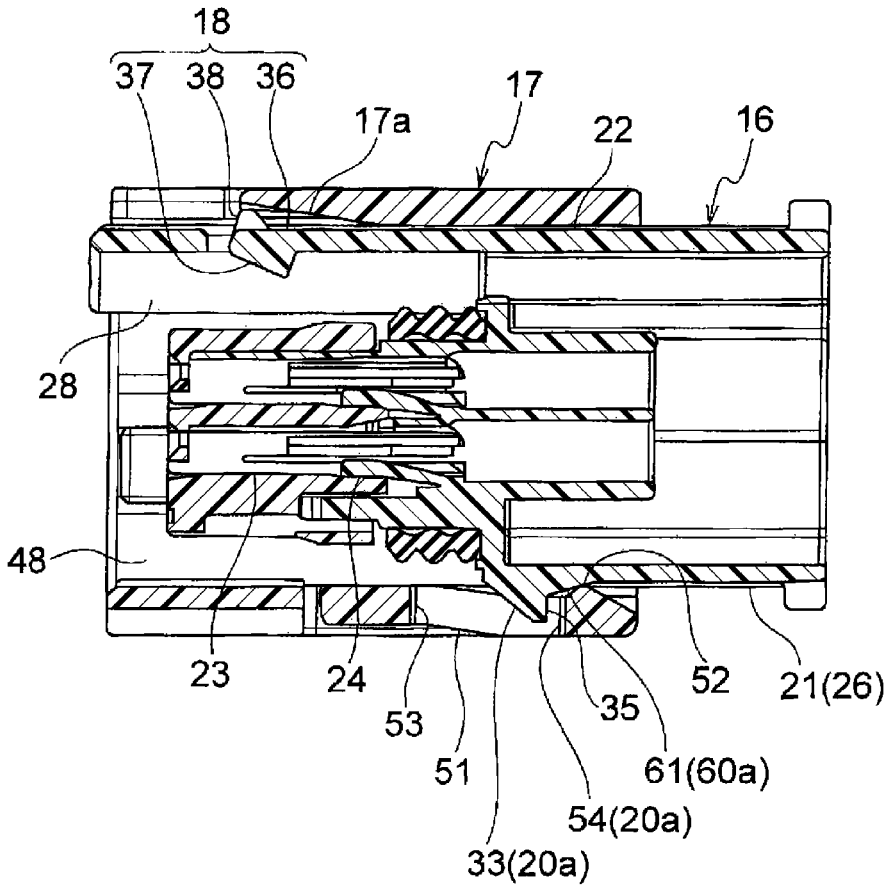
FIG. 9 is an illustrative view of an operation corresponding to FIG. 7.
Figure 10:
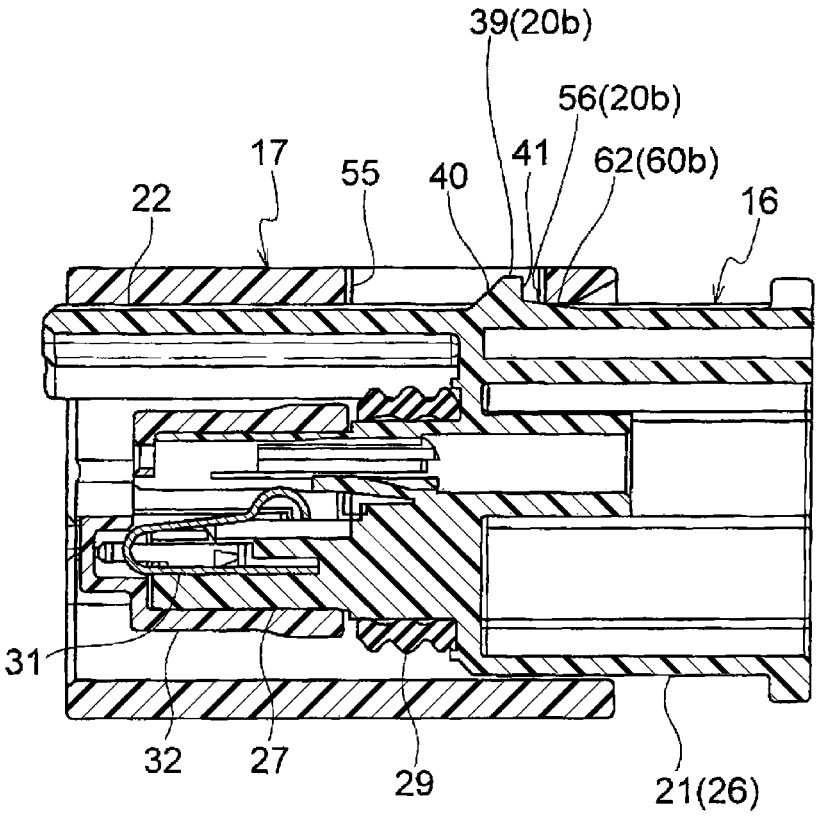
FIG. 10 is a cross-sectional view showing one form in a direction indicated by arrows C to C in FIG. 6.

In the present embodiment, on a sliding surface of the outer periphery of the inner housing 16 in sliding contact with the sliding surface of the inner periphery of the outer housing 17, the inclined surface 61 serves as the sliding load portion 60*a* is provided closer to first stepped portion 54 side than the position of the first claw portion 33, and the inclined surface 62 that serves as the sliding load portion 60*b* is provided closer to the second stepped portion 56 side than the position of each second claw portion 39. Therefore, when the fitting operation is released midway such as when the hand moves away from the inner housing 16 in the half fitting position and the inner housing 16 is pushed back to the rear in the fitting direction by the biasing force of the spring members 19, before the claw portions 33 and 39 abut against the corresponding stepped portions 54 and 56 respectively, the corresponding sliding surface of the outer housing 17 gets over each of the inclined surfaces 61 and 62 (FIGS. 9 and 10). Accordingly, since the sliding frictional force between the sliding surfaces of the two housings 16 and 17 can be increased before the claw portions 33 and 39 abut against the corresponding stepped portions 54 and 56 respectively, the speed at which the inner housing 16 is pushed back to the rear in the fitting direction can be reduced. As a result, the impact that acts on the pushback regulating portion 20 when the claw portions 33 and 39 of the pushback regulating portion 20 abut against the corresponding stepped portions 54 and 56 respectively can be reduced. Accordingly, the sliding load portions 60*a* and 60*b* relieve the impact that acts on the pushback regulating portion 20. Therefore, even though the biasing force of the spring member 19 is increased, the occurrence of troubles (damage or the like) in the pushback regulating portion 20 can be suppressed.

In the present embodiment, since the first claw portion 33 and the first inclined surface 61, and the second claw portion 39 and the second inclined surface 62 are respectively integrally formed, the shape of the inner housing 16 is simple. Therefore, the structure of the mold that molds the inner housing 16 can be simplified, and the manufacturing cost can be kept low.

In the present embodiment, an example is described in which the first claw portion 33 and the second claw portions 39 are respectively formed in the inner housing 16 and the first hole portion 53 having the first stepped portion 54 and the second hole portions 55 having the second stepped portions 56 are respectively formed in the outer housing 17. However, the present invention is not limited thereto. For example, the first claw portion 33 and the second claw portions 39 are respectively formed in the outer housing 17 and the first hole portion 53 having the first stepped portion 54 and the second hole portions 55 having the second stepped portions 56 are respectively formed in the inner housing 16. In this case, the sliding load portions 60*a* and 60*b* are respectively provided with the inclined surfaces 61 and 62 closer in the fitting direction to the stepped portions 54 and 56 sides than the claw portions 33 and 39 of the outer housing 17.

For the first inclined surface 61 and the second inclined surface 62 of the present embodiment, by properly setting inclination angle, maximum height and the like of each inclined surface, the sliding friction between the sliding surfaces in sliding contact with each other of the two housings 16 and 17 can be adjusted to a desired magnitude. Therefore, by setting shapes and dimensions of the first inclined surface 61 and the second inclined surface 62 according to the biasing force of the spring member 19, the occurrence of troubles in the pushback regulating portion 20 can be more reliably suppressed.

Hereinafter, other embodiments of a connector including a sliding load portion different from that in the first embodiment will be described. However, each of these embodiments is basically the same as that of the first embodiment. Therefore, hereinafter, only the sliding load portion as a characteristic configuration of each embodiment will be described, and the same reference numerals are given to the configurations common to that of the first embodiment, and the explanation will be omitted.

Second Embodiment

The present embodiment is provided with sliding load portions 70*a* and 70*b* that increase the sliding friction by cooperation of both sliding surfaces, before the claw portions 33 and 39 abut against the corresponding stepped portions 54 and 56 with respect to the sliding surfaces of the inner housing 16 and the outer housing 17, which are in sliding contact with each other.

Figure 11:
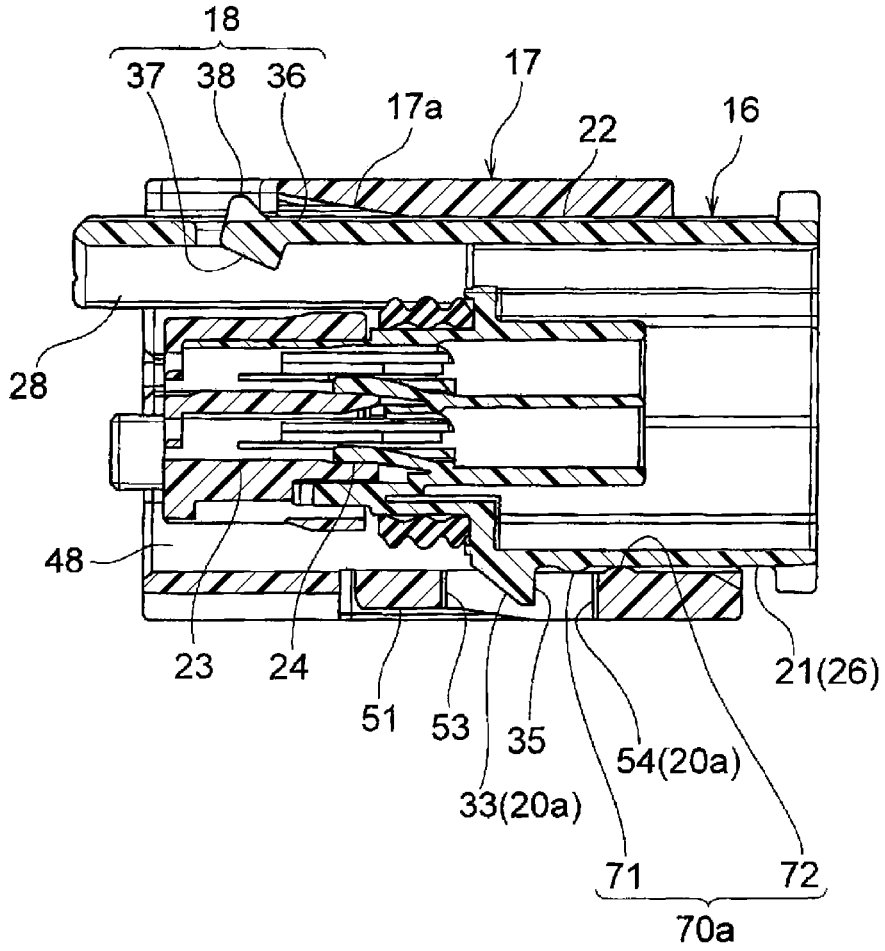
FIG. 11 is a cross-sectional view corresponding to the direction indicated by arrows A to A in FIG. 6 according to a second embodiment of the present invention.

As shown in FIG. 11, the sliding load portion 70*a* includes a protruding portion 71 provided closer to the first stepped portion 54 side than the position where the first claw portion 33 of the lower surface (one sliding surface) of the base portion 26 of the housing body 21 of the inner housing 16 is formed, and a protruding portion 72 provided on the sliding surface of the corresponding inner periphery (mating sliding surface) of the outer housing 17 to be capable of getting over the protruding portion 71. The protruding portion 72 is in sliding contact with a flat surface portion between the rear end surface 35 of the first claw portion 33 and the protruding portion 71 on the lower surface of the base portion 26 of the housing body 21 after getting over the protruding portion 71. Although the protruding portion 71 and the protruding portion 72 are set to have substantially the same dimension of trapezoidal shape cross section, the cross-sectional shape is not limited thereto, and may be, for example, circular arc.

Figure 12:
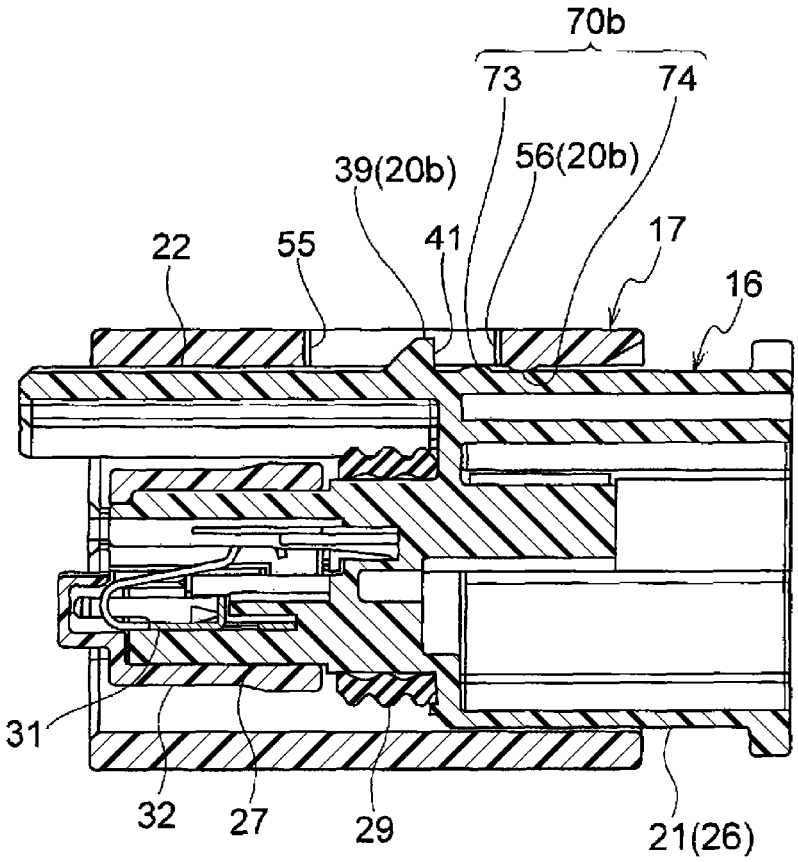
FIG. 12 is a cross-sectional view corresponding to the direction indicated by arrows B to B in FIG. 6 according to the second embodiment of the present invention.
Figure 13:
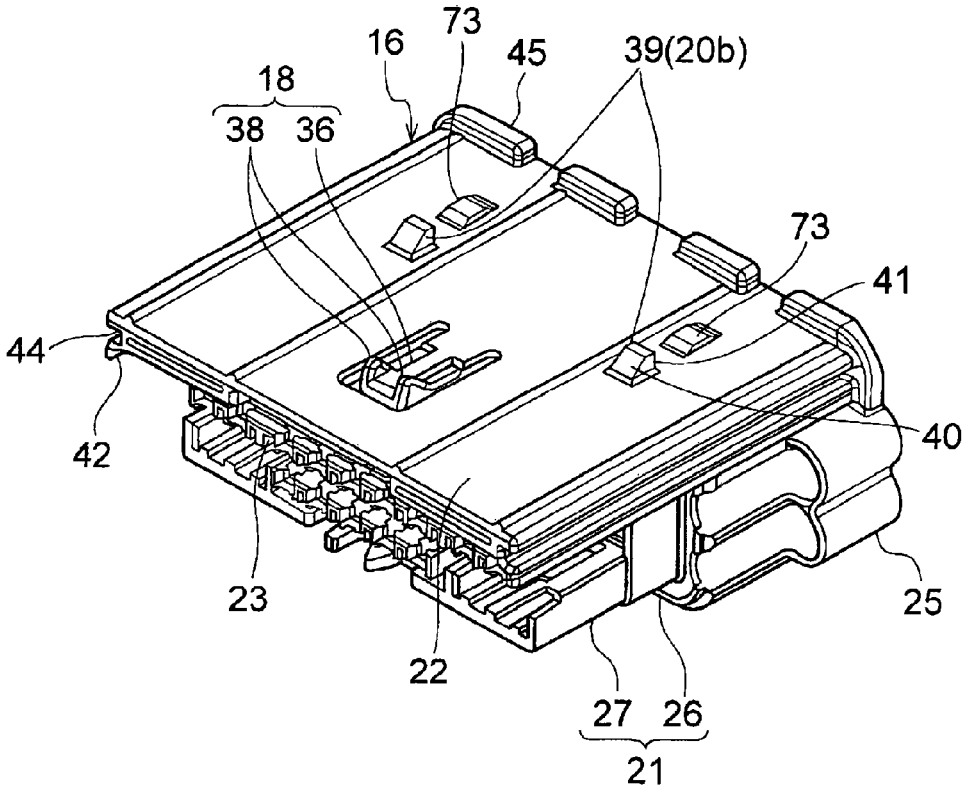
FIG. 13 is an external perspective view of the inner housing according to the second embodiment of the present invention.

As shown in FIGS. 12 and 13, the sliding load portion 70*b* includes a protruding portion 73 provided closer to the second stepped portions 56 side than the position where each second claw portion 39 of the upper surface (one sliding surface) of the hood portion 22 of the inner housing 16 is formed, and a protruding portion 74 provided on the sliding surface of the corresponding inner periphery (mating sliding surface) of the outer housing 17 to be capable of getting over the protruding portion 73. The protruding portion 74 are in sliding contact with the flat surface portion between the rear end surface 41 of the second claw portion 39 and the protruding portion 73 on the upper surface of the hood portion 22 of the inner housing 16 after getting over the protruding portion 73. Although the protruding portion 73 and the protruding portion 74 are set to have substantially the same dimension of trapezoidal shape cross section, the cross-sectional shape is not limited thereto, and may be, for example, circular arc.

The present embodiment is provided with the sliding load portion 70*a* including the protruding portion 71 provided closer to the first stepped portion 54 side than the position where the first claw portion 33 of the sliding surface of the inner housing 16 is formed and the protruding portion 72 provided on the corresponding sliding surface of the outer housing 17 to be capable of getting over the protruding portion 71, as well as the sliding load portions 70*b* including the protruding portions 73 provided closer to the second stepped portion 54 side than the position where each second claw portion 39 of the sliding surface of the inner housing 16 is formed and the protruding portion 74 provided on the corresponding sliding surface of the outer housing 17 to be capable of getting over the protruding portion 73. Therefore, when the fitting operation is released midway such as when the hand moves away from the inner housing 16 in the half fitting position and the inner housing 16 is pushed back to the rear in the fitting direction by the biasing force of the spring member 19, before the claw portions 33 and 39 abut against the corresponding stepped portions 54 and 56 respectively, the protruding portion 72 gets over the protruding portion 71 and the protruding portion 74 gets over the protruding portion 73. Accordingly, since the sliding frictional force between the sliding surfaces of the two housings 16 and 17 can be increased before the claw portions 33 and 39 abut against the corresponding stepped portions 54 and 56 respectively, the speed at which the inner housing 16 is pushed back to the rear in the fitting direction can be reduced. As a result, the impact that acts on the pushback regulating portion 20 when the claw portions 33 and 39 of the pushback regulating portion 20 abut against the corresponding stepped portions 54 and 56 respectively can be reduced. Therefore, even though the biasing force of the spring member 19 is increased, the occurrence of troubles (damage or the like) in the pushback regulating portion 20 can be suppressed.

In the present embodiment, an example is described in which the first claw portion 33 and the second claw portions 39 are respectively formed in the inner housing 16 and the first hole portion 53 having the first stepped portion 54 and the second hole portions 55 having the second stepped portions 56 are respectively formed on the sliding surface of the outer housing 17. However, the present invention is not limited to thereto. For example, the first claw portion 33 and the second claw portions 39 are respectively formed on the sliding surface of the outer housing 17 and the first hole portion 53 having the first stepped portion 54 and the second hole portions 55 having the second stepped portions 56 are respectively formed on the sliding surface of the inner housing 16. In this case, the sliding load portions 70*a* and 70*b* are respectively provided with protruding portions 71 and 73 closer in the fitting direction to the stepped portions 54 and 56 sides than the claw portion 33 and 39 of the outer housing 17, as well as protruding portions 72 and 74 on the corresponding sliding surfaces of the inner housing 16 to be capable of getting over the protruding portions 71 and 73.

For the first and second protruding portions 71, 72, 73 and 74 of the present embodiment, by properly setting cross-sectional shape and protrusion height, the sliding friction between the sliding surfaces in sliding contact with each other of the two housings 16 and 17 can be adjusted to a desired magnitude. Therefore, by setting cross-sectional shapes and protrusion heights of the first and second protruding portions 71, 72, 73 and 74 according to the biasing force of the spring member 19, the occurrence of troubles in the pushback regulating portion 20 can be more reliably suppressed.

Third Embodiment

The present embodiment is provided with a sliding load portion 80 that increases the sliding friction by cooperation of both sliding surfaces, before a pair of second claw portions 39 abut against the corresponding stepped portions 56 with respect to the sliding surfaces of the inner housing 16 and the outer housing 17, which are in sliding contact with each other.

Figure 14:
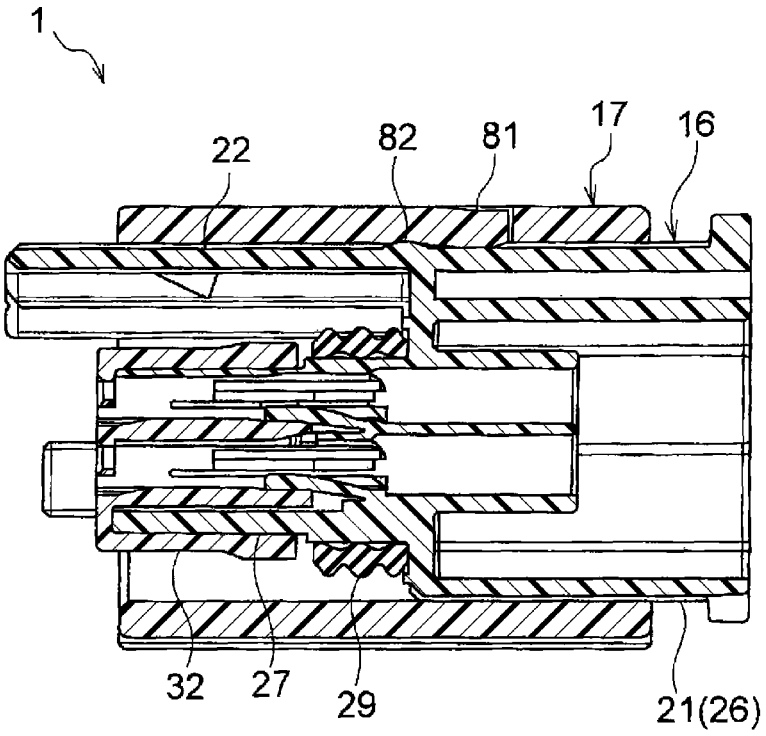
FIG. 14 is a cross-sectional view of the connector according to a third embodiment of the present invention.
Figure 15:
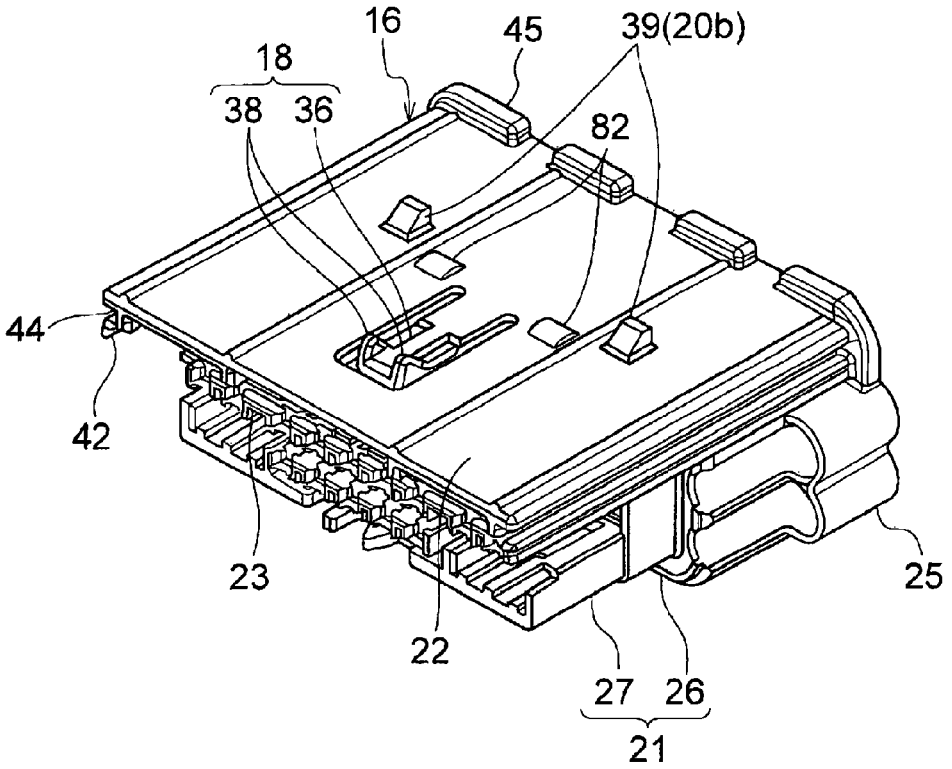
FIG. 15 is a side view of the inner housing.
Figure 16:
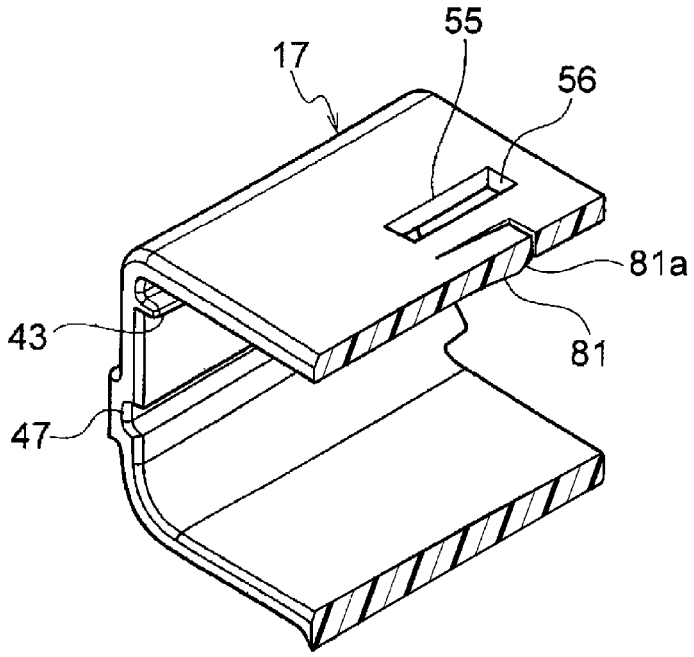
FIG. 16 is a sectional perspective view of an outer housing.

As shown in FIGS. 14 to 16, the sliding load portion 80 includes a pair of arm portions 81 that protrude to be elastically deformable toward the upper surface (mating sliding surface) of the hood portion 22 of the inner housing 16 by notching a part of the sliding surface of the outer housing 17, and a pair of protruding portions 82 provided on the upper surface of the hood portion 22 of the inner housing 16 in sliding contact with tip ends of the pair of arm portions 81. In other words, the pair of arm portions 81 are configured to elastically press an inner wall surface (one sliding surface) of the outer housing 17 toward the upper surface (the other sliding surface) of the hood portion 22 of the inner housing 16, and the pair of protruding portions 82 are provided on the upper surface (the other sliding surface) of the hood portion 22 to be in sliding contact with the pair of arm portions 81.

As shown in FIG. 15, the pair of protruding portions 82 are provided at positions (inward than the pair of second claw portions 39) shifted in a direction orthogonal to the fitting direction with respect to the second claw portions 39 respectively. The pair of protruding portions 82 are provided to be shifted from the second claw portions 39 in the fitting direction and are provided at positions in sliding contact with the tip ends of the arm portions 81 before the pair of second claw portions 39 abut against the corresponding second stepped portions 56. Although each of the protruding portions 82 is set to have substantially the same dimension of arc shape cross section, the cross-sectional shape is not limited thereto, and may be, for example, trapezoidal.

As shown in FIG. 16, the pair of arm portions are notched longitudinally around the outer housing 17 and extend inward to the rear (semi fitting direction). A lower portion of the tip end of each arm portion 81 is provided with an inclined surface 81*a* in sliding contact with the protruding portion 82.

The present embodiment are provided with the sliding load portion 80 including the arm portions 81 that protrude to be elastically deformable from the sliding surface of the inner periphery of the outer housing 17 toward the sliding surface of the outer periphery of the inner housing 16, and the protruding portions 82 that protrude from the sliding surface of the inner housing 16 in sliding contact with the tip ends of the arm portions 81. Therefore, when the fitting operation is released such as when the hand moves away from the inner housing 16 in the half fitting position and the inner housing 16 is pushed back to the rear in the fitting direction by the biasing force of the spring member 19, before the claw portions 33 and 39 abut against the corresponding stepped portions 54 and 56 respectively, the inclined surfaces 81*a* of the tip ends of the pair of arm portions 81 are respectively in sliding contact with the protruding portions 82. Accordingly, since the sliding friction between the sliding surfaces of the two housings 16 and 17 can be increased before the claw portions 33 and 39 abut against the corresponding stepped portions 54 and 56 respectively, the speed at which the inner housing 16 is pushed back to the rear in the fitting direction can be reduced. As a result, the impact that acts on the pushback regulating portion 20 when the claw portions 33 and 39 of the pushback regulating portion 20 abut against the corresponding stepped portions 54 and 56 respectively can be reduced. Therefore, even though the biasing force of the spring member 19 is increased, the occurrence of troubles (damage or the like) in the pushback regulating portion 20 can be suppressed.

In the present embodiment, an example is described in which the pair of arm portions 81 are formed on the sliding surface of the outer housing 17 and the pair of protruding portions 82 are formed on the sliding surface of the inner housing 16. However, the present invention is not limited thereto. For example, the pair of arm portions 81 may be formed on the sliding surface of the inner housing 16 and the pair of protruding portions 82 may be formed on the sliding surface of the outer housing 17. In the present embodiment, although the example is described in which the pair of protruding portions 82 are provided inward than the pair of second claw portions 39, if the pair of protruding portions 82 and the arm portions 81 are set such that the tip ends of the arm portions 81 are in sliding contact with the protruding portions 82 before the claw portions 33 and 39 abut against the corresponding stepped portions 54 and 56, the set positions and the setting number are not limited to the example of the present embodiment. For example, in addition to the example of the present embodiment, another protruding portion 82 can be provided on the lower surface of the base portion 26 of the housing body 21 of the inner housing 16, and another arm portion 81 can be provided on the corresponding sliding surface of the outer housing 17. Accordingly, according to the present embodiment, since the sliding load portion 80 is provided at a predetermined position irrespective of the position of the pushback regulating portion 20, the sliding load portion 80 can be designed remarkably freely.

For the protruding portion 82 of the present embodiment, by properly setting cross-sectional shape and protrusion height, the sliding friction between the sliding surfaces in sliding contact with each other of the two housings 16 and 17 can be adjusted to a desired magnitude. Therefore, by setting cross-sectional shape and protrusion height of the protruding portion 82 according to the biasing force of the spring member 19, the occurrence of troubles in the pushback regulating portion 20 can be more reliably suppressed.

While specific embodiments have been described above, the present invention is not limited to appearances and configurations in the embodiments, and modifications, additions and deletions are possible without changing the spirit of the present invention.

The characteristics of the connector according to the above-described embodiments of the present invention will be briefly summarized and listed in the following items (1) to (4).

(1) A connector includes a tubular inner housing (16) that holds connecting terminals therein; a tubular outer housing (17) that surrounds an outer periphery of the inner housing and is slidable in a fitting direction; a locking mechanism (18) that locks the inner housing with a mating connector (2) at a fitting position; a spring member (19) that biases the inner housing to a rear in the fitting direction to push back the inner housing with respect to the outer housing when a fitting operation is released in a state that the inner housing is in a half fitting position; and a pushback regulating portion (20) that regulates a position where the inner housing is pushed back to the rear in the fitting direction, wherein the pushback regulating portion (20) includes a claw portion (33, 39) that protrudes from a first sliding surface (upper surface of 22, lower surface of 26) of one (16) of the inner housing and the outer housing; a stepped portion (54, 56) that is provided on a second sliding surface (upper inner wall surface, lower inner wall surface of 16) of the other (17) of the inner housing and the outer housing and abut against the claw portion when the inner housing is pushed back; and a sliding load portion (60, 70, 80) that makes a sliding frictional force between the first sliding surface and the second sliding surface at a predetermined timing before the claw portion and the stepped portion abut against each other to be larger than the sliding frictional force before the predetermined timing.

(2) The connector according to (1), wherein the sliding load portion (60) has an inclined surface (61, 62) which is provided at a position, closer to the stepped portion (54, 56) than the claw portion (33, 39), of the first sliding surface and which is inclined to be away from the first sliding surface as approaching the claw portion.

(3) The connector according to (1), wherein the sliding load portion (70) includes a first protruding portion (71, 73) provided at a position, closer to the stepped portion than the claw portion (33, 39), of the first sliding surface; and a second protruding portion (72, 74) provided on the second sliding surface to be capable of getting over the first protruding portion.

(4) The connector according to (1), wherein the sliding load portion (80) includes an arm portion (81) configured to elastically press one of the first sliding surface and the second sliding surface toward the other of the first sliding surface and the second sliding surface; and a third protruding portion (82) provided on the other of the first sliding surface and the second sliding surface in sliding contact with the arm portion.

According to the present invention, in a connector including a mechanism that pushes back a housing by utilizing an biasing force of a spring member during half fitting, an impact that acts on the mechanism can be reduced. The present invention having this effect is useful for connectors.

What is claimed is:

1. A connector comprising:

a tubular inner housing configured to hold connecting terminals therein;

a tubular outer housing configured to surround an outer periphery of the inner housing and to be slidable in a fitting direction;

a locking mechanism configured to lock the inner housing with a mating connector at a fitting position;

a spring member configured to bias the inner housing to a rear in the fitting direction to push back the inner housing with respect to the outer housing when a fitting operation is released in a state that the inner housing is in a half fitting position; and a pushback regulating portion that regulates a position where the inner housing is pushed back to the rear in the fitting direction, wherein the pushback regulating portion includes:

a claw portion that protrudes from a first sliding surface of one of the inner housing and the outer housing;

a stepped portion that is provided on a second sliding surface of the other of the inner housing and the outer housing and is configured to abut against the claw portion when the inner housing is pushed back; and a sliding load portion that makes a sliding frictional force between the first sliding surface and the second sliding surface at a predetermined timing before the claw portion and the stepped portion abut against each other to be larger than the sliding frictional force before the predetermined timing; and wherein the sliding load portion includes:

a first protruding portion provided at a position closer to the stepped portion than the claw portion of the first sliding surface; and a second protruding portion provided on the second sliding surface to be capable of getting over the first protruding portion.

2. A connector comprising:

a tubular inner housing configured to hold connecting terminals therein;

a tubular outer housing configured to surround an outer periphery of the inner housing and to be slidable in a fitting direction;

a locking mechanism configured to lock the inner housing with a mating connector at a fitting position;

a spring member configured to bias the inner housing to a rear in the fitting direction to push back the inner housing with respect to the outer housing when a fitting operation is released in a state that the inner housing is in a half fitting position; and a pushback regulating portion that regulates a position where the inner housing is pushed back to the rear in the fitting direction, wherein the pushback regulating portion includes:

a claw portion that protrudes from a first sliding surface of one of the inner housing and the outer housing;

a stepped portion that is provided on a second sliding surface of the other of the inner housing and the outer housing and is configured to abut against the claw portion when the inner housing is pushed back; and a sliding load portion that makes a sliding frictional force between the first sliding surface and the second sliding surface at a predetermined timing before the claw portion and the stepped portion abut against each other to be larger than the sliding frictional force before the predetermined timing, and wherein the sliding load portion includes:

an arm portion configured to elastically press one of the first sliding surface and the second sliding surface toward the other of the first sliding surface and the second sliding surface; and a third protruding portion provided on the other of the first sliding surface and the second sliding surface in sliding contact with the arm portion.

* * * * *